United States Patent [19]

Shyu

[11] Patent Number: 4,916,456

[45] Date of Patent: Apr. 10, 1990

[54] GLASS-MOUNTABLE ANTENNA ASSEMBLY

[76] Inventor: Don Shyu, No. 957, Po Ai St., Chupei City, Hsingchu Hsien, Taiwan

[21] Appl. No.: 350,779

[22] Filed: May 12, 1989

[51] Int. Cl.[4] ..... H01Q 1/32

[52] U.S. Cl. ..... 343/713; 343/715

[58] Field of Search ..... 343/713, 715, 745, 749, 343/750, 850, 860, 861

[56] References Cited

U.S. PATENT DOCUMENTS 4,621,243 11/1986 Harada ..... 343/715
4,785,305 11/1988 Shyu ..... 343/715
4,825,217 4/1989 Choi ..... 343/715

FOREIGN PATENT DOCUMENTS 0137391 4/1985 European Pat. Off. ..... 343/715

*Primary Examiner*—Rolf Hille
*Assistant Examiner*—Doris J. Johnson
*Attorney, Agent, or Firm*—Zarley, McKee, Thomte, Voorhees & Sease

[57] ABSTRACT

An antenna for mounting on a non-conductive surface such as a windshield of an automobile coupled by a capacitor incorporating the windshield as the dielectric medium between the two capacitor plates. The protrusion which receives the antenna acts as one capacitor plate and a PCB acts as the inner capacitor plate.

1 Claim, 3 Drawing Sheets

GLASS-MOUNTABLE ANTENNA ASSEMBLY

BACKGROUND OF THE INVENTION

This invention relates to an antenna with non-conductive surfaces in which the antenna is mounted on one side of the non-conductive surface with the signal being capacitively transmitted through the non-conductive surface from/to the inside.

It has long been known that radio frequency (RF) signals may be coupled through an insulating material, such as glass, by mounting a conduction plate on each side of the insulating material and thereby forming a coupling capacitor.

Numerous problems relating to things like balanced transmission frequency, gain radiant noise, interference, radiation patterns etc. have brought about countless solutions. Many of these solutions were quite ingenious and novel such that patents have been granted.

Most recently what is commonly known as a Cellular Phone has become quite popular. These phones are in fact transceivers which operate in the radio frequency bands of approximately 800 MHz. In conjunction with this device, antennas particularly suited to these frequencies have been developed. Illustrations of those relating to glass-mounting may be found in U.S. Pat. No. 8,601,415 to Larsen Electronics Inc. and my own U.S. Pat. No. 4,785,305.

Although my U.S. Pat. No. 4,785,305 was a significant improvement in the art and substantial reduction in cost of such antennas, there is still room for improvement.

DETAILED DESCRIPTION OF THE PREFERRED EMBODIMENT

Figure 1:
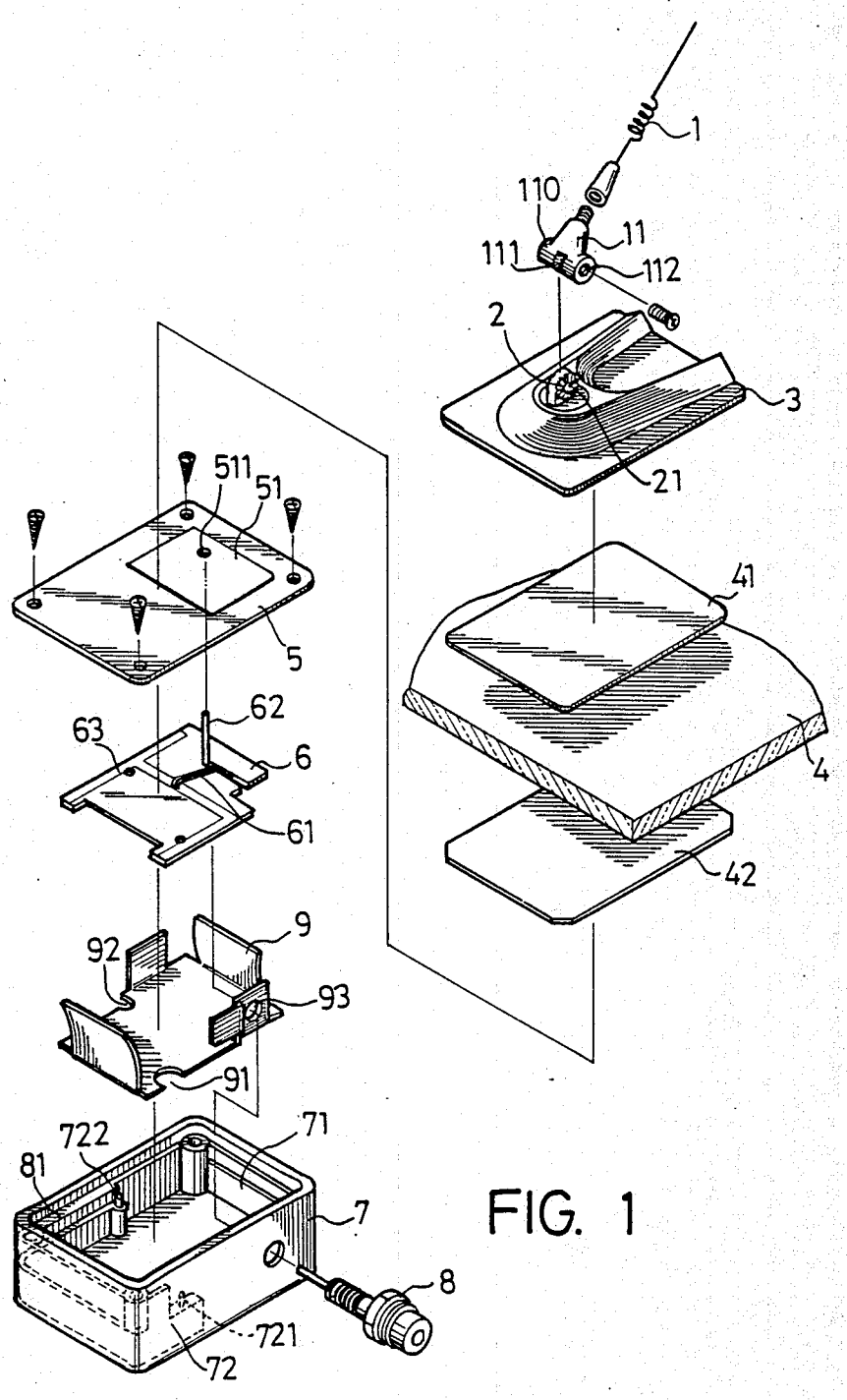
FIG. 1 is an exploded perspective view of a glass-mountable antenna in accordance with the present invention.
Figure 2:
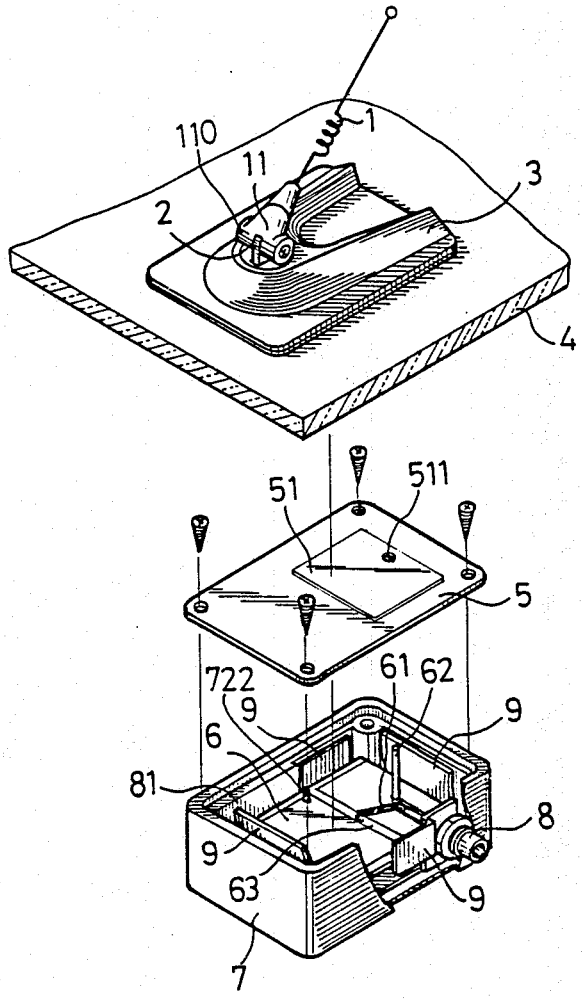
FIG. 2 is a partially exploded perspective view of the glass-mountable antenna of FIG. 1.
Figure 4:
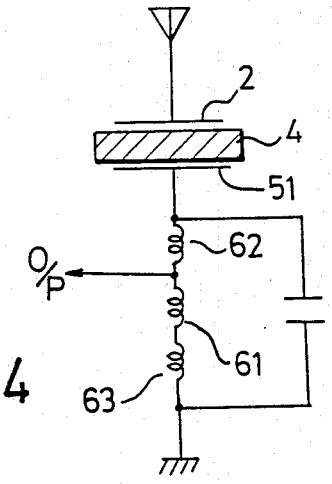
FIG. 4 is an equivalent circuit diagram for the glass-mountable antenna.
Figure 3:
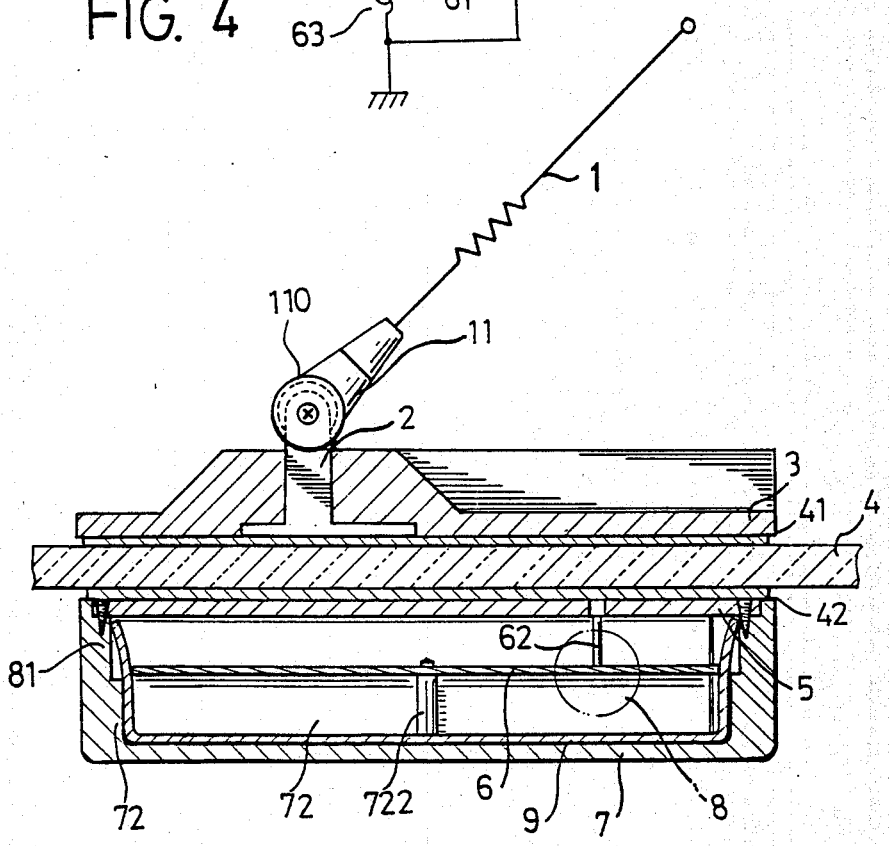
FIG. 3 is cross-sectional view of a glass-mountable antenna in accordance with the present invention.

Referring first to FIG. 1 wherein an embodiment of a glass-mounted antenna in accordance with the present invention is shown, an electrically shortened antenna 1 with a flexible whip portion is secured, by a conventional means, to the antenna base 11. The antenna base 11 is in turn secured to the outer mounting plate 3. Engagement of the antenna base 11 to the outer mounting plate 3 is accomplished as follows:

A cylindrical section 110 of the antenna base 11 is integrally molded perpendicular to the antenna 1. The cylindrical section 110 is centrally bored therethrough (identified by 112). Midway along the cylindrical section 110, a slot 111 is disposed which is perpendicular to the bore 112. The surfaces of the slot 111 are provided with serrations radiating outwardly. A semicircular protrusion 2 extends perpendicularlly form the upper surface of the mounting plate 3. The opposing semicircular surfaces are serrated in similar fashion to the slot 111. Through the center of the protrusion 2 perpendicular to the semi-circular surfaces is a circular bore 21. The slot 111 of the antenna base 11 is placed over the protrusion 2 and a screw 22 is passed through to the bores 112 and 21. It should be noted that one side of the bore 21 opposite the head of the screw 22 is threaded to engage with the screw 22. As the screw 22 is tightened, the serrations engage to hold the antenna 1 in a fixed position.

The electrically insulated outer mounting plate 3 is essentially rectangular with a U-shaped rib integrally formed on the upper surface. The material of the protrusion 2 is metallic and the back thereof is electrically conductive to receive the signal from the antenna 1. As such, the entire protrusion 2 serves as an outer plate of the coupling capacitor. The entire assembly of the antenna 1 and outer mounting plate 3 are secured to the outer surface of the glass 4 (in this case windshield by means of an appropriate double-sided adhesive tape 41).

On the inside of the glass 4 is disposed a housing 7. The housing 7 is made of a thermoplastic insulating material and is essentially an open top rectangular box. A PCB (Printed Circuit Board) 5 forms the cover to the housing 7 and is secured by four screws positioned at the four corners of the PCB 5. On the outer surface of the PCB 5 is disposed a rectangular pattern foil trace 51 which serves as the inner plate of the coupling capacitor. Further, the PCB 5 is provided with a hole 511 therethrough at an appropriate location to receive the metal wire 62. As can be understood, the outer mounting plate 3 and the pattern foil trace 51 comprise a capacitor plate so that an electromagnetic signal can be transmitted through the windshield, thereby eliminating the need to drill a hole through the windshield.

Within the housing 7 is disposed a supporting plate 72. The supporting plate 72 is preferably an injection molded thermoplastic U-shaped part which fits the inner contour of the housing 7. The height is approximately half the height of the sides of the housing 7 and extends across one end and approximately half the distance along two of the sides of the housing 7. Also, at each end of the supporting plate 72 and at approximately the midpoint of the opposite side are disposed respective semi-circular cylindrical protrusions 721 or 722 formed integrally with the support plate 72. At the end opposite to the support plate 72 is another support panel 71 of like material. Again, the support panel 71 is the same height as the support plate 72. Slightly higher than the support panel 72 but lower than the sides of the housing 7 is another support panel 81, which is used to receive the PCB 5.

Also, disposed within the housing 7 is a ground shield 9. The ground shield 9 is composed of a thin metal sheet folded and shaped to essentially cover the interior of the housing 7. Above the ground shield 9 and supported on the support plate 72 and the support panel 17 is an inner PCB 6. The inner PCB 6 is basically rectangular with appropriate cut outs for the jack 8 and ground shield 9. Extending upward form the inner PCB 6 to and through the hole 511 for the PCB 5 is the afore-mentioned metal wire 62. The metal wire 62 is made secure and electrically conductive with the foil trace 51 by conventional means, such as soldering.

On the surface of the inner PCB 6 is a copper wire 61. This copper wire 61 is in electrical contact with the metal wire 62. The copper wire 61 is also in electrical contact with an inductor in parallel, the function of the inductor being emulated by a microstrip filter 63. The entire inside assembling is juxtaposed with the antenna base 3 and secured to the inner surface of the glass 4 by another double-sided adhesive tape 42. Disposed on a side wall of the housing 7 is a circular opening for the jack 8 to pass through and secure therein. The jack 8, which is a conventional design RF shielded cable jack, is electrically connected to the junction of the copper wire 61 and the metal wire 62.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. In a glass mountable antenna assembly comprising an antenna (1) secured to an antenna base (11), an electrically conductive outer mounting plate (3) for receiving said antenna base (11) and receiving an electromagnetic signal from said antenna (1) and transmitting said electromagnetic signal through a sheet of glass to a pattern foil trace (51) of a PCB (5) on the opposite side of said sheet of glass, a metal wire (62) being electrically connected to said pattern foil trace (51) on one end thereof, a microstrip filter (63) being electrically bridged by a copper wire (61) and connected to said metal wire (62) and emulating an inductor, a jack (8) electrically connecting to the junction of said copper wire (61) and said metal wire (62) to receive a signal therefrom, the improvement comprising:

a housing (7) being made of a thermoplastic insulating material and having an open top rectangular box shape with said PCB (5) including said pattern foil trace (51) forming the cover to said housing (7) at the top of said housing (7) and securing thereto, said housing (7) having a support plate (72) and a support panel (71) disposed therewithin and positioned at opposite sides in the interior of the housing (7), said support plate (72) and support panel (71) having a height approximately half the height of the sides of said housing (7) for supporting an inner PCB (6) which has said copper wire (61), said metal wire (62) and said microstrip filter (63) disposed thereon, a ground shield (9) housing being composed of a thin metal sheet folded and shaped to essentially cover the interior of said housing (7), a substantial portion of the ground shield being positioned along the bottom of the housing (7) generally parallel to the inner PCB (6); and said pattern foil trace (51) at the top of said housing (7) and said ground shield (9) at the bottom of said housing (7) forming a static capacitor for interacting with said intermediately positioned microstrip filter (63).

* * * * *